US011078766B2

(12) United States Patent
Knoeller et al.

(10) Patent No.: US 11,078,766 B2
(45) Date of Patent: Aug. 3, 2021

(54) JET PUMP CONTROLLER WITH DOWNHOLE PREDICTION

(71) Applicant: Weatherford Technology Holdings, LLC, Houston, TX (US)

(72) Inventors: Michael C. Knoeller, Humble, TX (US); Clark E. Robison, Tomball, TX (US); Manish Agarwal, Cypress, TX (US); Bryan A. Paulet, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 42 days.

(21) Appl. No.: 16/363,592

(22) Filed: Mar. 25, 2019

(65) Prior Publication Data

US 2020/0308942 A1 Oct. 1, 2020

(51) Int. Cl.

| | |
|---|---|
| ***E21B 43/12*** | (2006.01) |
| ***E21B 47/008*** | (2012.01) |
| ***E21B 47/06*** | (2012.01) |
| ***E21B 41/00*** | (2006.01) |

(52) U.S. Cl.

CPC ..... *E21B 43/126* (2013.01); *E21B 41/0092* (2013.01); *E21B 47/008* (2020.05); *E21B 47/06* (2013.01); *E21B 43/124* (2013.01)

(58) Field of Classification Search

CPC ..... E21B 43/126; E21B 47/008

See application file for complete search history.

(56) References Cited

U.S. PATENT DOCUMENTS

| | | | | |
|---|---|---|---|---|
| 4,698,152 | A * | 10/1987 | Carroll | B04C 5/28 210/96.1 |
| 6,244,831 | B1 * | 6/2001 | Kawabata | F04B 49/002 417/213 |
| 6,873,267 | B1 | 3/2005 | Tubel et al. | |
| 7,114,572 | B2 | 10/2006 | Batho et al. | |
| 2007/0231158 | A1 | 10/2007 | Butler et al. | |
| 2013/0018605 | A1 * | 1/2013 | Peterson | G01F 23/0076 702/55 |

(Continued)

OTHER PUBLICATIONS

Armstrong, O; "Summary of Oil Jet Pump Principles & Applications"; obtained from www.oiljetpump.com; dated 2010.

(Continued)

*Primary Examiner* — Robert E Fuller
*Assistant Examiner* — Lamia Quaim
(74) *Attorney, Agent, or Firm* — Blank Rome LLP

(57) ABSTRACT

An artificial lift system has a surface pump operated by a prime mover powered by a variable speed drive. A jet pump disposed downhole in tubing receives pressurized power fluid from the surface pump, mixes the power and production fluid and delivers the product uphole. A controller disposed at surface adjusts the artificial lift system relative to a set value based on a measured discharged pressure or a measured flowrate and trends a change in the other of the measured flowrate or the measured discharged pressure over time. The controller can also trend an operating condition (intake pressure vs. production rate) to determine changes relative to cavitation conditions. Based on the trended changes, the controller initiates an operation in the artificial lift system, such as adjusting the discharge pressure, initiating an alarm condition, etc.

18 Claims, 6 Drawing Sheets

(56) References Cited

U.S. PATENT DOCUMENTS

| | | | | |
|---|---|---|---|---|
| 2017/0074089 | A1 | 3/2017 | Agarwal et al. | |
| 2018/0181830 | A1* | 6/2018 | Luharuka | G06K 9/4642 |
| 2018/0340551 | A1 | 11/2018 | Hesami et al. | |
| 2018/0372123 | A1* | 12/2018 | Kurkjian | F04F 5/48 |
| 2020/0040888 | A1* | 2/2020 | Zhang | F04B 49/20 |

OTHER PUBLICATIONS

Moon, T.; "Jet Pumps"; Oilfield Review 2016, copyright 2016.
Oilfiled Magazine; "Subsea hydraulic jet pump optimizes well development offshore Tunisia"; dated Nov. 18, 2015.
Rotating Right; "Weatherford Hydraulic Lift Systems"; undated; obtained from www.rotatingright.com on Feb. 25, 2019.
Weatherford, "Jet-Pump Lifting Systems," Brochure, copyright 2015.

* cited by examiner

JET PUMP CONTROLLER WITH DOWNHOLE PREDICTION

BACKGROUND OF THE DISCLOSURE

Many hydrocarbon wells are unable to produce at commercially viable levels without assistance in lifting the formation fluids to the earth's surface. Various forms of artificial lift are used to produce from these types of wells. For example, a well that produces oil, gas, and water may be assisted in the production of fluids with a hydraulic jet pump. This type of system typically includes a surface power fluid system, a prime mover, a surface pump, and a downhole jet pump.

The jet pump must be properly sized to meet the given well condition. The sizing requires a number of calculations that account for fluid densities and viscosities, presence of gas, and other conditions that have an effect on what pressures the jet pump may encounter downhole. Currently, a desktop software program is used to set up and predict the operation of the jet pump system. To first configure the system, a user inputs information about the particular implementation into the program, which then calculates various results. This is normally done in an office setting. The results are then communicated to operators in the field who then configure the system so the jet pump can begin operating properly. Over time, the efficiency of the system decreases due to the changing conditions in the well, changes in the system, installation errors, and the like.

Eventually, the jet pump system no longer operates efficiently and production for the well declines. The system may also need repair, may become damaged, may fail, or the like. At some point, the field operators must then provide updated information of the system, its operation, well production, etc. to office operators so the updated information can be input again into the desktop software program and updated configuration results can be calculated for relay back to the field. As would be expected, there can be considerable delay in getting correct information to and from the field, running the software program, and then getting the results back to field to adjust the system. Often, there is break-down in communication. Moreover, in some instances, the software is only used during the initial set up, and the jet pump system is never or rarely optimized, which can lead to failures.

One available desktop software program is the Jet Pump Evaluation and Modeling Software (JEMS) software available from Weatherford International. The JEMS software is used to customize a jet pump system for a given well application. Information for the well application is input into the JEMS software to simulate anticipated downhole conditions and performance ranges for various operating scenarios. Output from the software can then be used to configure the system for operation.

As a brief example, the software can estimate nozzle and throat sizes to deliver artificial lift for the particular well application. The overall objective of using the software is to select an optimal nozzle and throat combination so the system can achieve the most production from the well while using the least amount of hydraulic horsepower to operate it.

To size the nozzle and throat, the performance of the jet pump is compared to a production rate and a pump intake pressure of the well. The configuration produced by the analysis attempts to keep the jet pump within operating limits and to avoid cavitation. As is known, cavitation can occur in a downhole jet pump when the jet pump's intake is starved for liquid, when the local fluid pressure in the jet pump drops below the vapor pressure of gas in solution, or when existing gas bubbles are ingested into the downhole jet pump. For example, production cavitation occurs when static pressure at the jet pump's throat is equal to or less than the vapor pressure of the liquid being produced because too much produced fluid is being forced through the area available for it in the jet pump's throat. Power fluid cavitation occurs when there is too little production.

Cavitation produces imploding bubbles that can damage components of the jet pump. For example, the intersecting and mixing of fluids in the throat of the downhole jet pump may result in conditions that lead to cavitation, which can damage the throat. The damage can eventually change the area of the throat and decrease performance.

When production efficiency drops, field operators need to adjust or repair the jet pump system. Cavitation damage may cause the system production rate to fall significantly, sometimes to zero. In any case, the system may have to be shut down or set to a maintenance mode to allow for repairs of the jet pump system and its components. Before production at full capacity can be resumed, the downhole jet pump may be removed from the wellbore, and damaged pump components may need to be replaced with other components (or the entire pump may need to be replaced). This typically involves waiting for the replacement components to be shipped, which can result in significant system downtime and production loss.

What is needed is a system that helps configure, operate, and optimize a jet pump system in real time, i.e., without the need to transfer the information to the location with the software. To that end, the subject matter of the present disclosure is directed to overcoming, or at least reducing the effects of, one or more of the problems set forth above.

SUMMARY OF THE DISCLOSURE

According to the present disclosure, a first form of artificial lift system is used for producing production fluid from a well having tubing disposed therein. The system comprises a surface unit, a jet pump, a first pressure transducer, a flowmeter, and a controller.

The surface unit disposed at surface has a suction line in communication with a source of power fluid and has a discharge line in communication with the well. The surface unit is operable to pressurize the power fluid from the suction line to the discharge line. The jet pump is disposed downhole in the tubing and receives the pressurized power fluid. The jet pump mixes the power fluid and the production fluid and outputs a product of the mixed fluid for delivery to the surface. The first pressure transducer is disposed to measure discharge pressure in the discharge line of the surface unit, and the flowmeter is disposed to measure discharge flowrate in the discharge line of the surface unit.

The controller is disposed in communication with the surface unit, the first pressure transducer, and the flowmeter. The controller is configured to: adjust the artificial lift system relative to a set value based on a first of the measured discharge pressure or flowrate, trend a change in a second of the measured discharge flowrate or pressure over time, and initiate an operation in the artificial lift system based on the trended change.

The surface unit can comprise: a variable speed drive; a prime mover powered by the variable speed drive; and a surface pump connected to the prime mover and operable by the prime mover to pressurize the power fluid from the suction line to the discharge line.

The system can further comprise at least one of: a second pressure transducer disposed to measure suction pressure in the suction line of the surface pump; a vibration sensor disposed at the surface pump, the controller being configured to monitor vibration of the surface pump and compare the monitored vibration to a vibration threshold; an oil level sensor disposed at the surface pump, the controller being configured to monitor oil level of the surface pump and compare the monitored oil level to an oil level threshold; and a temperature sensor disposed at the prime mover, the controller being configured to monitor temperature of the prime mover and compare the monitored temperature to a temperature threshold.

The prime mover can comprise an electric motor coupled to the variable speed drive. The surface pump can comprise a positive displacement pump coupled to the prime mover with a gear box, or the surface pump can comprise a centrifugal pump coupled to the prime mover with a thrust chamber.

In one configuration, the discharge line is disposed in communication with the tubing or an annulus between the tubing and the well. The jet pump is disposed downhole in the tubing and receives the power fluid from the tubing or the annulus. The jet pump outputs the product of the mixed fluid to the other of the annulus or the tubing for delivery to the surface. The jet pump can comprise a nozzle, a throat, a diffuser, and an outlet, the nozzle disposed in communication with the power fluid in the tubing, the throat disposed in communication with the production fluid and the nozzle, the diffuser receiving a mix of the power fluid and the production fluid from the throat, the outlet disposed in communication between the diffuser and the annulus.

In one configuration of the controller to adjust the artificial lift system relative to the set value, the controller is configured to compare the measured discharge pressure to the set value for discharge pressure and adjust a variable speed drive of the surface unit based on the comparison. To trend the change, the controller can be configured to periodically trend the discharge flowrate over time and compare a rate of change of the trended flowrate relative to a threshold. To initiate the operation, the controller can be configured, based on the comparison of the rate to the threshold, to at least one of: adjust the variable speed drive, shutdown a prime mover of the surface unit, adjust the discharge flowrate, adjust the discharge pressure, initiate an alarm condition, request a repair, and request a replacement.

In another configuration of the controller to adjust the artificial lift system relative to the set value, the controller is configured to compare the measured flowrate to the set value for the discharge flowrate and adjust a variable speed drive of the surface unit based on the comparison. To trend the change, the controller can be configured to periodically trend the discharge pressure over time and compare a rate of change of the trended discharge pressure relative to a threshold. To initiate the operation, the controller can be configured, based on the comparison of the rate to the threshold, to at least one of: adjust the variable speed drive, shutdown a prime mover of the surface unit, adjust the discharge flowrate, adjust the discharge pressure, initiate an alarm condition, request a repair, and request a replacement.

In a configuration of the controller, the controller is configured to calculate an operating condition of the jet pump based on an intake pressure at the downhole jet pump as a function of a production rate of the product from the well. To adjust the artificial lift system, the controller can be configured to: calculate a first area of the intake pressure at the jet pump as a function of the production rate predicted to produce cavitation in the product, determine that the operating condition lies within the first area, and adjust a variable speed drive of the surface unit based on the determination. To adjust the artificial lift system, the controller can be configured to: calculate a second area of the intake pressure at the jet pump as a function of the production rate predicted to produce cavitation in the power fluid, determine that the operating condition lies within the second area, and adjust the variable speed drive of the surface unit based on the determination.

According to the present disclosure, a second form of artificial lift system is used for producing production fluid from a well having tubing disposed therein. The system comprises a surface unit, a jet pump, a first pressure transducer, a flow meter, and a controller.

The surface unit disposed at surface has a suction line in communication with a source of power fluid and has a discharge line in communication with the well. The surface unit is operable to pressurize the power fluid from the suction line to the discharge line.

The jet pump is disposed downhole in the tubing and receives the pressurized power fluid. The jet pump mixes the power fluid and the production fluid and outputs a product of the mixed fluid for delivery to the surface.

The first pressure transducer is disposed to measure discharge pressure in the discharge line of the surface pump, and the flowmeter is disposed to measure discharge flowrate in the discharge line of the surface pump.

The controller is disposed in communication with the surface unit, the first pressure transducer, and the flowmeter. The controller is configured to: adjust the artificial lift system relative to a set value based on the measured discharge pressure or flowrate, determine an operating condition of the jet pump based on an intake pressure at the downhole jet pump as a function of a production rate of the product from the well, trend a change in the operating condition over time, and initiate an operation in the artificial lift system based on the trended change.

Additional features of this second form of artificial lift system can be similar to those discussed previously with reference to the first form.

According to the present disclosure, a first form of artificial lift method is used for producing fluid from a well having tubing disposed therein. The method comprises: pressurizing, with a surface unit of an artificial lift system disposed at surface, a power fluid from a suction line to a discharge line; injecting the pressurized power fluid of the discharge line into the well; receiving the power fluid at a jet pump of the artificial lift system disposed downhole, mixing the power fluid and the production fluid in the jet pump, and outputting a product of the mixed fluid for delivery to the surface; monitoring, with a controller disposed in operable control of the surface unit, a discharge pressure of the surface unit with a pressure transducer and a discharge flowrate of the surface unit with a flowmeter; adjusting, with the controller, the artificial lift system relative to a set value based on a first of the measured discharge pressure or flowrate; trending, with the controller, a change in a second of the measured discharge flowrate or pressure over time; and initiating, with the controller, an operation in the artificial lift system based on the trended change.

According to the present disclosure, a second form of artificial lift method is used for producing fluid from a well having tubing disposed therein. The method comprises: pressurizing, with a surface unit of an artificial lift system disposed at surface, a power fluid from a suction line to a discharge line; injecting the pressurized power fluid of the discharge line into the well; receiving the power fluid at a jet pump of the artificial lift system disposed downhole, mixing the power fluid and the production fluid in the jet pump, and outputting a product of the mixed fluid from the jet pump for delivery to the surface; monitoring, with a controller disposed at surface and disposed in operable control of the variable speed drive, a discharge pressure of the surface unit with a pressure transducer and a discharge flowrate of the surface unit with a flowmeter; adjusting, with the controller, the artificial lift system relative to a set value based on the measured discharge pressure or flowrate; determining an operating condition of the jet pump based on an intake pressure at the downhole jet pump as a function of a production rate of the product from the well; trending, with the controller, a change in the operating condition over time; and initiating, with the controller, an operation in the artificial lift system based on the trended change.

Features of these two forms of artificial lift method can be used in combination with one another. Moreover, the methods can perform steps based on the details related to the forms of artificial lift systems described previously.

The foregoing summary is not intended to summarize each potential embodiment or every aspect of the present disclosure.

DETAILED DESCRIPTION OF THE DISCLOSURE

Figure 1A:
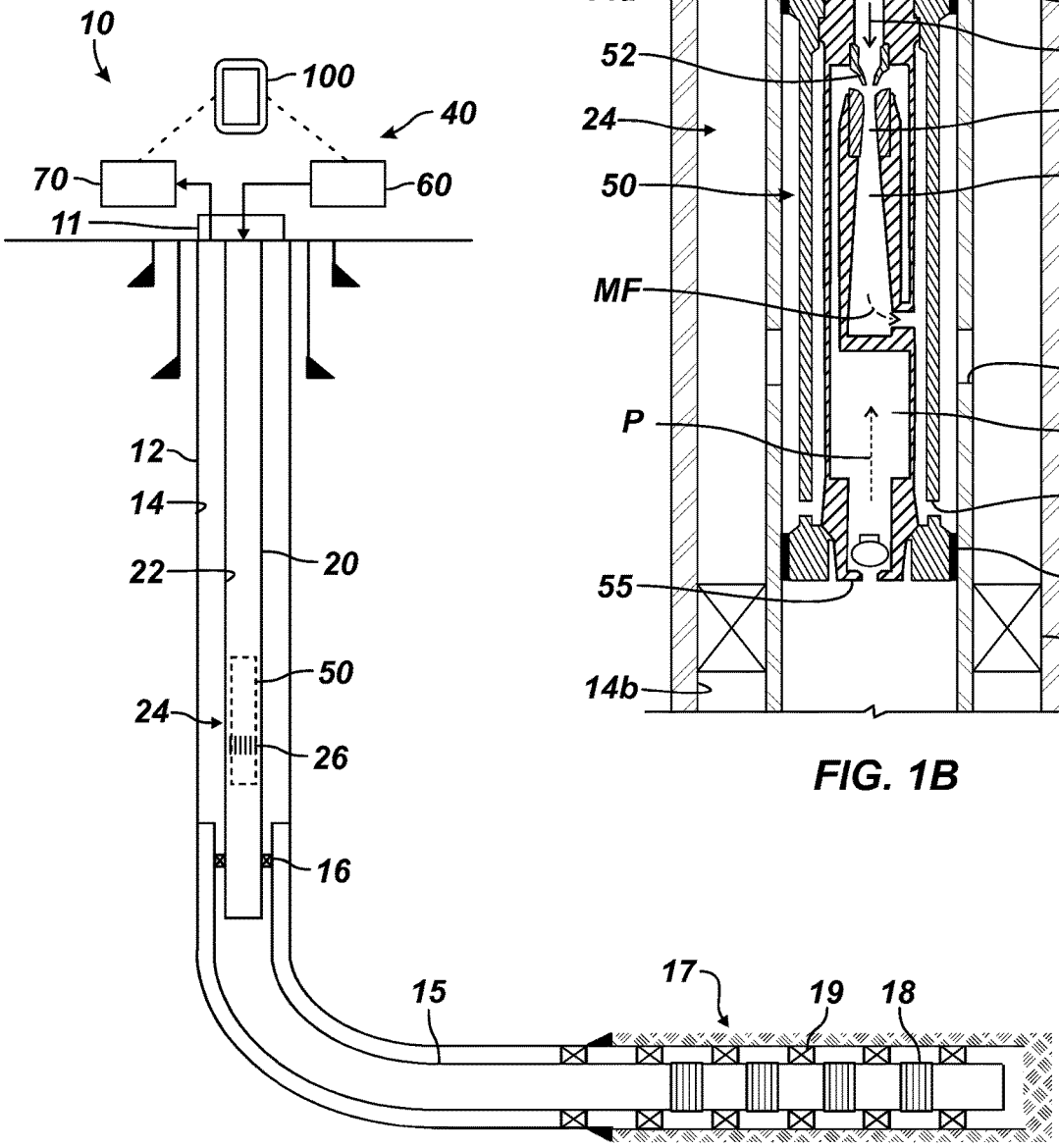
FIG. 1A illustrates a completion configured for artificial lift using a hydraulic jet pump system according to the present disclosure.

FIG. 1A illustrates a completion 10 having an artificial lift system 40 according to the present disclosure. The completion 10 includes casing 12 extending into a well to one or more production zones 17 downhole in a formation. As will be appreciated, the casing 12 typically includes a liner 15 having perforations, screens 18, isolation packers 19, inflow control devices, sliding sleeves, or the like at the production zones 17 for entry of formation fluids into the annulus 14 for eventual production at the surface.

Tubing 20 extends from the surface into the well and defines a throughbore 22 communicating with a bottom hole assembly 24. As schematically shown here, the bottom hole assembly 24 includes a packer 16 that seals off the annulus 14 in the casing 12/liner 15, as the case may be. The bottom hole assembly 24 also includes production ports 26 that communicate the throughbore 22 with the annulus 14.

As is known, a typical well may start its life with a high production rate produced by the natural flow of produced fluids from the well. As the formation is depleted, however, the production rate falls so that artificial lift is needed. Therefore, the completion 10 is configured with a hydraulic jet pump system 40 suited for artificial lift of the production fluid from the well. The lift equipment for the system 40 includes a downhole jet pump 50 installed in the bottom hole assembly 24 and includes a surface power fluid unit 60. A conditioning unit 70 at surface can condition received fluid and can separate oil from gas and water. Finally, the lift system 40 includes a jet pump controller 100, which can be used for several wells or can serve one well on an individual basis. As a general example for the well, the tubing 20 can range in size from about 1½ to 3-in., and a maximum production rate for the jet pump system 40 can range from 400 B/D (60 m3/d) to 5,000 B/D (800 m3/d).

Figure 1B:
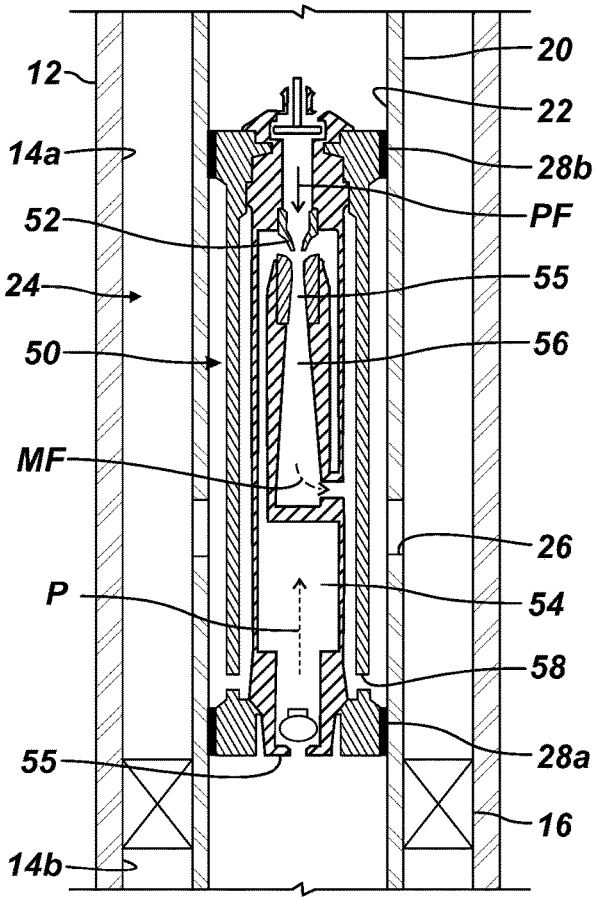
FIG. 1B illustrates the bottom hole assembly having a downhole jet pump.

With a general understanding of the completion 10 and the hydraulic jet pump system 40, FIG. 1B illustrates portion of the completion's bottom hole assembly 24 having an example of a downhole jet pump 50 according to the present disclosure in more detail. Again, as shown, the completion 10 includes the casing 12 (or liner 15) for the well. The bottom hole packer 16 seals the annulus 14 of the casing 12 (or liner 15) with the tubing 20 disposed in the casing 12. Also, the tubing 20 includes the throughbore 22 having one or more production ports 26 communicating with the upper annulus 14*a*. As is common, the bottom hole assembly 24 on the tubing 20 can include a plurality of interconnected housings, components, tubulars, and the like connected together, which are not necessarily depicted here for simplicity.

As noted previously, the production equipment is configured for hydraulic lift using the downhole jet pump 50. Using conventional running techniques, such as wireline, slickline, coiled tubing, or the like, the downhole jet pump 50 has been run into position into the bottom hole assembly 24. For example, the assembly 24 can include one or more internal elements (e.g., seals or seats) 28*a-b* disposed relative to the one or more ports 26. These elements 28*a-b* can be bore seals in the form of polished bores for engaging seals of the downhole jet pump 50 inserted therein. In some implementations, the elements 28*a-b* may include seal rings, nipples, latch profiles, seats, and the like for engaging the downhole jet pump 50 removably inserted in the equipment's throughbore 32. As one example, a profile, such as an X-lock profile, may be provided in the throughbore 22 to lock the disclosed jet pump 50 in place.

The lift equipment can also include a standing valve 55 disposed at the inlet of the downhole jet pump 50. The standing valve 55 can be part of (or installed on) the downhole jet pump 50 and can be run in with it. Alternatively, the standing valve 55 may be an independent component run separately.

The downhole jet pump 50 includes a nozzle 52, and inlet 54, a throat 55, a diffuser 56, and an outlet 58. As noted herein, components of the downhole jet pump 50 are preferably configured to suit production requirements and downhole conditions. For example, different configurations and materials can be used for the nozzle 52, the throat 55, and the diffuser 56.

During a hydraulic lift operation, the power-fluid unit (60), including power fluid storage, surface pump, prime mover, flow controls, and the like, pressurizes a power fluid PF and injects the pressurized power fluid PF into the throughbore 22 of the tubing 20. The power fluid PF travels down the tubing 20. At the jet pump 50, the power fluid PF enters the inlet nozzle 52. Meanwhile, production P isolated downhole in the lower annulus 14*b* can flow up through the throughbore 22 past the standing valve 55 and into the inlet 54 of the downhole jet pump 50. For its part, the standing valve 40 prevents escape of production fluid P from the hydraulic jet pump 50 downhole in the absence of sufficient fluid level.

The nozzle 52 reduces the fluid pressure of the power fluid PF using the Venturi effect. This draws production fluid P into the pump's throat 55 where the power fluid FP and production fluid P combine. The mixed fluid MF then transfers to the pump diffuser 56, where pressure is increased at the pumps outlet 58 so the mixed fluid MF can exit ports 26 and can be raised to the surface in the annulus 14*a*.

In the previous arrangement, the jet pump 50 operates with the power fluid PF communicated from surface down the throughbore 22 so that the mixed fluid MF can travel up the annulus 14*a*. A reverse operation can also be used. In particular, the jet pump 50 can be installed in the throughbore 22, and power fluid PF can be communicated from surface down the annulus 14*a* where it can then enter the jet pump 50 through the port 26, 58. As before, production P rising up the throughbore 32 from downhole also enters the jet pump 50 and the two fluids mix therein. Finally, the mixed fluid MF then travels uphole to surface through the tubing's throughbore 22.

For this reverse arrangement, it may be desirable to have a lock profile to help retain the jet pump 50 sealed in the throughbore 22. For example, one of the elements 28*a-b* can include a profile to operably engage a corresponding lock dog (not shown) on the jet pump 50 to hold the jet pump 50 in place. The lock dogs can be operated using conventional wireline running procedures or the like. If the jet pump 50 does not have such lock dogs, then some other holddown component disposed uphole of the jet pump 50 can be used.

Figure 2A:
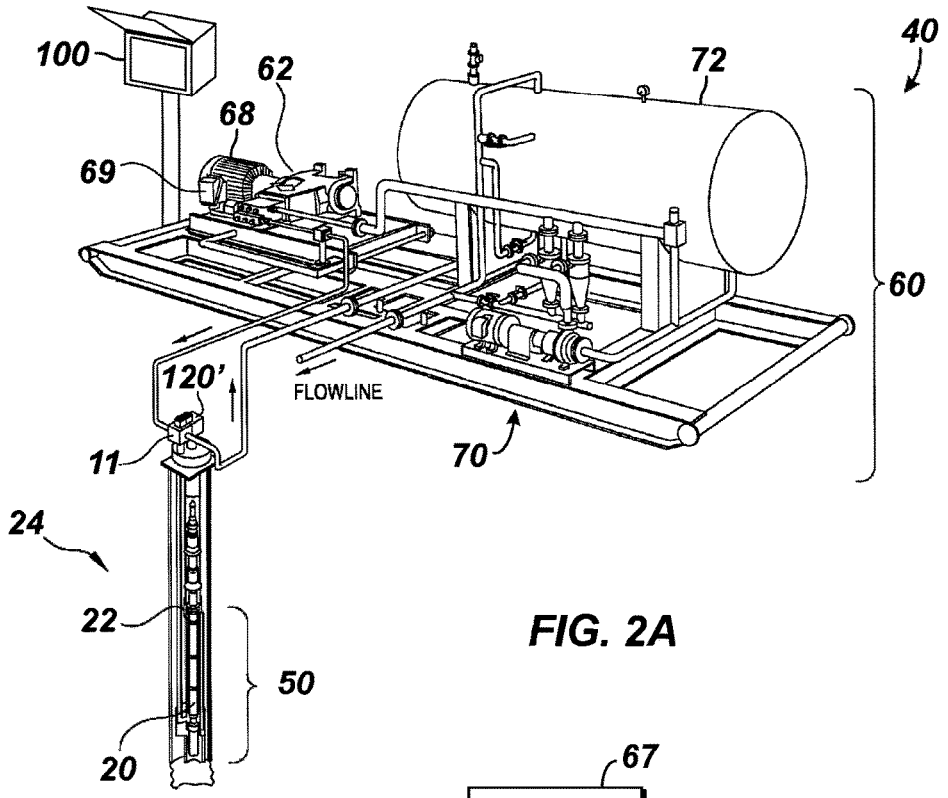
FIG. 2A illustrates some of the surface equipment of the jet pump system relative to the downhole jet pump.

FIG. 2A illustrates some of the component of the jet pump system 40 in additional detail. The power-fluid unit 60 on a skid at the surface can serve one well on an individual basis (as shown here) or can be used for several wells. The power-fluid unit 60 has a prime mover 68 and a surface pump 62 and is used for injecting power fluid into a wellhead 11 to operate the downhole jet pump 50 of the bottom hole assembly 24 disposed in the bore 22 of the tubing 20.

The power-fluid unit 60 can pressurize produced reservoir fluid to operate the downhole jet pump 50. For example, the surface pump 62 can include a multiplex pump ranging from 60 to 625 HP, and the prime mover 68 can include an electric motor or a multi-cylinder drive controlled by a variable speed drive 69.

The conditioning unit 70 on the skid at surface includes a vessel 72 to receive production fluid and exhausted power fluid from the well. The conditioning unit 70 cleans and conditions the received fluid and can separate oil from gas and water. Finally, the lift system 40 includes the jet pump controller 100, which can serve one well on an individual basis (as shown) or can be used for several wells.

Figure 2B:
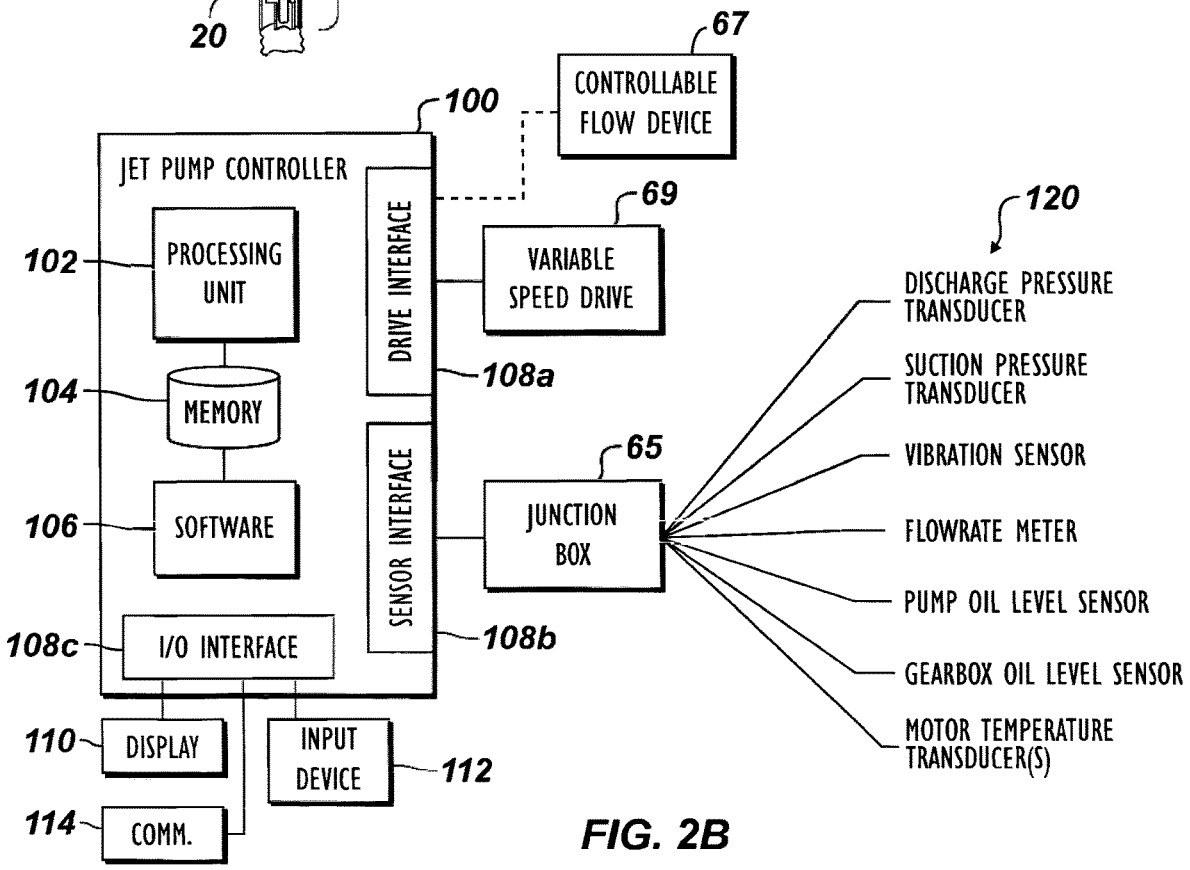
FIG. 2B illustrates a schematic of a jet pump controller of the present disclosure.

FIG. 2B illustrates a schematic of a jet pump controller 100 of the present disclosure. The controller 100 includes a processing unit 102, memory 104, software 106, a drive interface 108*a*, a sensor interface 108*b*, and an input/output interface 108*c*. The processing unit 100 and memory 104 can use any acceptable equipment suited for use in the field at a wellsite having artificial lift equipment according to the present disclosure. For example, the processing unit 102 can include a suitable processor, digital electronic circuitry, computer hardware, computer firmware, computer software, and any combination thereof. The memory 104 can include any suitable storage device for computer program instructions and data, such as EPROM, EEPROM, flash memory device, magnetic disks, magneto-optical disks, ASICs (application-specific integrated circuits), etc.

Software 106 operating on the controller 100 monitors inputs from a number of sensors 120, performs analysis, outputs information for a display 110, receives inputs from user input devices 112, and controls the prime mover with the variable speed drive 68 used for driving the hydraulic jet pump system (40). The software 106 includes algorithms for calculating parameters for the hydraulic jet pump system (40). These algorithms can be similar to those available from Jet Pump Evaluation and Modeling Software (JEMS) software available from Weatherford International.

The drive interface 108*a* connects to the variable speed drive 69 for the prime mover (i.e., motor) used for operating the surface pump of the system (40). The drive interface 108*a* can also connect to a controllable flow device 67 if necessary to control the discharge pressure in the discharge line of the surface unit (60).

The sensor interface 108*b* connects through a junction box 65 to the various sensors 120, such as pressure transducers, vibration sensors, flowrate meters, level sensors, and temperature transducers. As discussed in more detail below, these sensors 120 are configured and arranged on the hydraulic jet pump system (40) according to the type of surface pump used.

According to one aspect and a shown in FIG. 2A, the system 40 can further include a cavitation sensor 120', such as a microphone, an accelerometer, a vibrational sensor, or a gyroscope, associated with the wellhead 11 and/or the downhole jet pump 50. This cavitation sensor 120' can be configured to detect vibrations or other indications of cavitation, as taught in co-pending U.S. application Ser. No. 15/252,412, filed 31-Aug.-2016 and incorporated herein by reference.

The input/output interface 108*c* can connect to a display 110, an input device 112, and a communication interface 114. The display 110 on the controller 100 can be a touchscreen for the input device 112. The communication interface 114 can allow for download of inputs/upload of outputs through memory devices, wireless communications, etc.

At the controller 100, a field operator can manually input initial configuration data into the controller 100 through the display 110 and input device 112. Alternatively, the initial configuration data can be input via the communication interface 114, such as through a download from a storage device or from satellite or wireless communication. This initial configuration data typically includes configuration information and computational analysis, such as available in Weatherford's JEMS program. Several models have been constructed in the art based on theoretical and empirical analysis of jet pumps, and the computation of the controller 100 can be based on any suitable model.

For instance, operation of the downhole jet pump 50 can be modelled for efficiency based on various ratios of dimensional performance. Input variables of interest include reservoir depth; reservoir pressure; productivity index; depth of the downhole jet pump 50; peak efficiency; oil formation volume factor; cross-sectional area of the annulus 14*a*; cross-sectional area of the tubing 20; height of the jet pump 50; nozzle area; throat area; predicted pressures at the downhole jet pump 50, such as jet pump discharge pressure $P_D$, power fluid pressure $P_N$ at pump intake (nozzle), well pressure $P_S$ at pump intake (throat); pump intake flowrate $Q_S$; nozzle flowrate $Q_N$; characteristics (gradients) of the power fluid and the formation fluid; loss coefficients of nozzle and throat-diffuser; submergence S of pump-intake pressure to pump-discharge pressure; etc. In this way, operation of the jet pump 50 can be modelled using an area ratio R (nozzle area/throat area); pressure recovery ratio N (jet pump discharge pressure $P_D$ minus well pressure at pump intake $P_S$ all divided by power fluid pressure at pump intake $P_N$ minus pump discharge pressure $P_D$, each measured at the pump's depth; the flow ratio M ($Q_S/Q_N$); and a density ratio C of formation fluid to power fluid. The interrelation of the ratios is governed by known thermodynamic equations.

After the initial configuration from the inputs, proper sizing of the nozzle and throat, and configuration of operating parameters for the power-fluid unit (60), the controller 100 uses sensor inputs and computations in real-time to predict the bottom hole pressure and to optimize the output of the surface power unit 60 so that the jet pump 50 continues to run efficiently over time, even as operating conditions of the system 40 change. Analysis and solutions typically provide information, such as head pressures, bottom hole pressure, intake pressure, power fluid flow rate, produced fluid flow rate, hydraulic horsepower to be used, etc. Because knowledge of cavitation is important when operating the jet pump 50, the controller 100 also calculates and displays the cavitation limits of the system (40) based on the real-time information.

In this way, the controller 100 can optimize the run life of the jet pump 50 by keeping the jet pump 50 from getting into cavitation. The controller 100 can also track trends in the decline of the well and predict when the jet pump 50 will go into cavitation. These and several other functions can be handled by the controller 100, as discussed below. Although not discussed in detail here, it will be appreciated that the controller 100 can also be configured to operate and control the conditioning of the power fluid by the conditioning unit 70.

Figure 3:
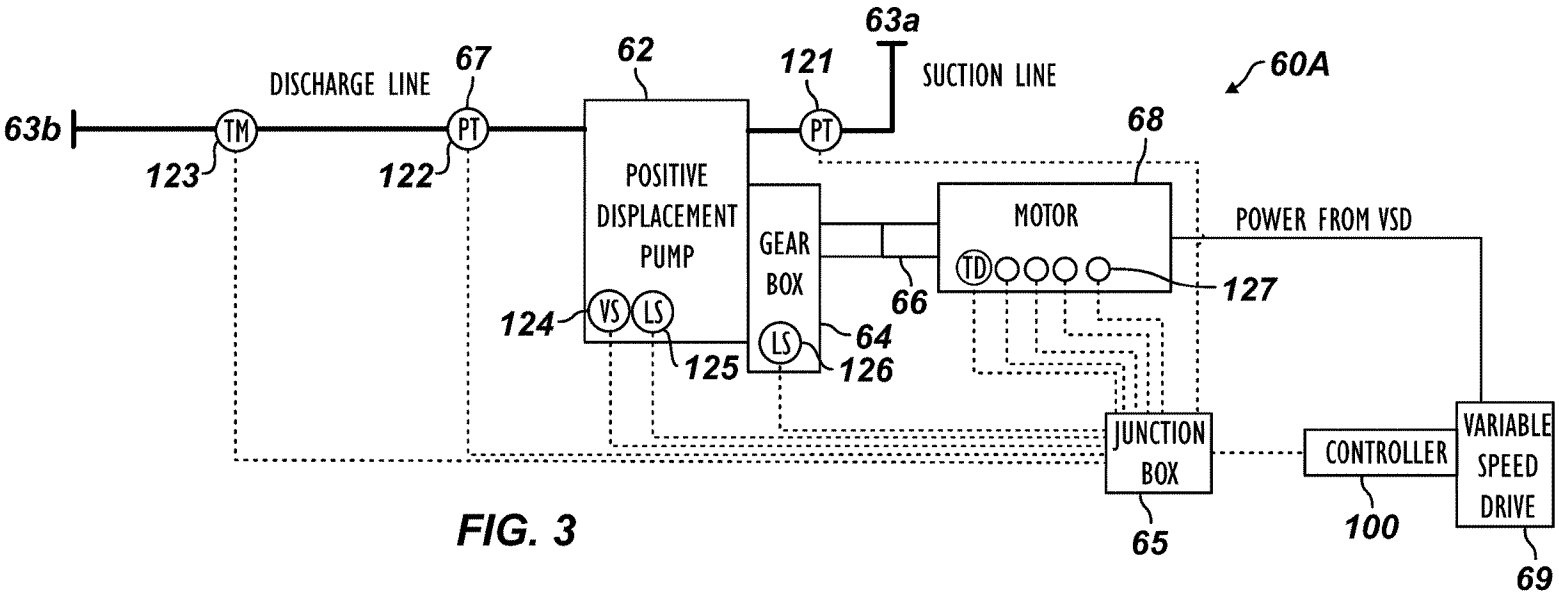
FIG. 3 illustrates the jet pump controller integrated into a positive displacement pump configuration of a surface power fluid unit.

As noted above, the controller 100 can be configured to operate with the hydraulic jet pump system 40 having different surface pumps 62 and using various sensors 120. In one example, FIG. 3 illustrates the jet pump controller 100 integrated into a positive displacement pump configuration for a power-fluid unit 60A. The positive displacement pump 62 can be a multiplex (e.g., triplex) pump or the like that is actuated by a prime mover (e.g., electric motor) 68 coupled to the surface pump 62 by a transmission 66, a gear box 64, and other necessary components to transfer the rotation of the motor 68 to operate the positive displacement pump 62. The controller 100 provides power to the motor 68 with the variable speed drive 69 to control the drive of the motor 68 to the surface pump 62.

When actuated, the surface pump 62 draws power fluid from a source through a suction line 63*a*, pressurizes the power fluid, and discharges the power fluid through a discharge line 63*b* for delivery to the downhole jet pump (50) in the well. (For instance, the suction line 63*a* can receive power fluid from the conditioning unit (70), and the discharge line 62*b* can connect to the wellhead (11) for delivering pressurized power fluid to the downhole jet pump via the tubing (20).)

The controller 100 is operatively coupled to the variable speed drive 69 and is connected in communication with sensors 120 distributed among the components of the configuration of the unit 60A. The controller 100 exchanges information with the drive 69 to control power to the motor 68. For example, the controller 100 can monitor and control motor parameters, such as Hz, amps, RPM, etc. Using the drive 69, the controller 100 can control of the flow of the power fluid for the system (40) (if needed) by controlling the speed of the motor 68 from the drive 69. If necessary, the controller 100 can also shut down the motor 68 with the drive 69. The positive displacement pump 62, by design, can be sped up or slowed down, and the result can be to change the flowrate. Changing the discharge pressure in the configuration can be achieved using a remotely controllable flow control device 67 integrated into the unit 60A at the surface. For example, this flow control device 67 can be a variable orifice, a relief valve, or the like that is controlled by the controller 100 to alter the pressure in the discharge line 63*b*.

To monitor the unit 60A, the controller 100 is operatively coupled to the junction box 65, which connects to the various sensors 120 for monitoring operation of the unit 60A. The sensors 120 monitor the input/output of the surface pump 62 and include a suction line pressure transducer 121 for measuring the pressure of the power fluid fed into the pump 62, a discharge pressure transducer 122 for measuring the pressure of the power fluid discharged from the surface pump 62, and a flowmeter 123 for measuring the flow rate of the power fluid from the surface pump 62.

The controller 100 determines a discharge pressure of the power fluid using the pressure transducer 122 and determines a flowrate of the power fluid using the flowmeter 123. The controller 100 calculates a bottom hole pressure at the jet pump (50) and also calculates a prediction of cavitation in the jet pump (50).

The controller 100 uses the sensors 120 to also monitor the surface pump 62 and includes a vibration sensor 124 for measuring vibration of the surface pump 62 and a level sensor 125 for monitoring the oil level of the surface pump 62. Excessive vibration of the surface pump 62 can indicate damage to the pump 62 or that the pump 62 is not set at optimal operating parameters. A low oil level may indicate that the surface pump 62 needs service.

The controller 100 uses the sensors to monitor the motor 68 for the surface pump 62. The motor 68 may include an electric motor, and a number of temperature transducers 127 can measure the temperature of the motor 68 at various locations to determine possible overheating and the like, indicating failure, or a need for service.

Any suitable pressure transducers, temperature sensors, and vibration sensors can be used. Briefly, a turbine meter can be used for the flowmeter. An accelerometer or a gyroscope can be used for the vibration sensor.

In the control of this configuration of the power-fluid unit 60A for the jet pump system (40), the software (106) of the controller (100) can provide a number of user interface screens for local display at the controller (100) or for access remotely via satellite, cellular, or other communication. For example, FIGS. 4A-4B illustrate user interface screens 150A, 160A of the jet pump controller (100) of FIG. 3 for monitoring and controlling operation of the configuration 60A in lifting production fluid from the well in conjunction with the downhole jet pump (50).

Figure 4A:
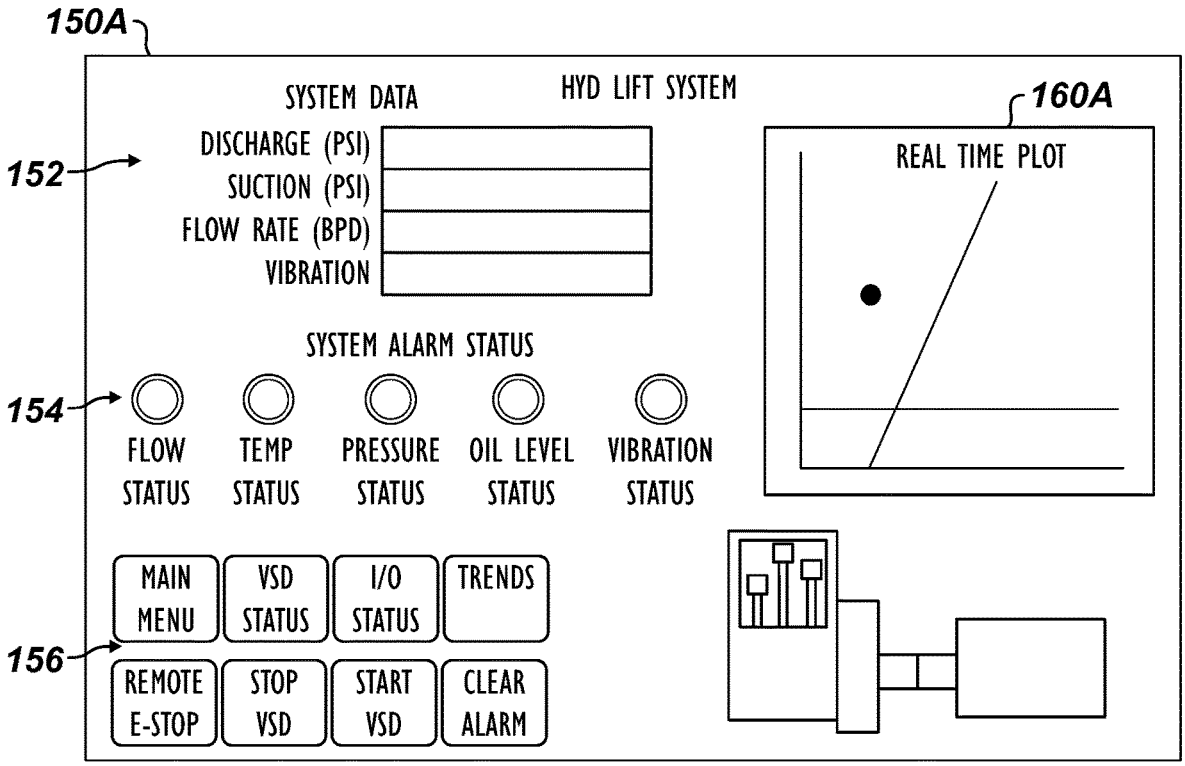
FIGS. 4A-4B illustrate user interface screens of the jet pump controller of FIG. 3.
Figure 4B:
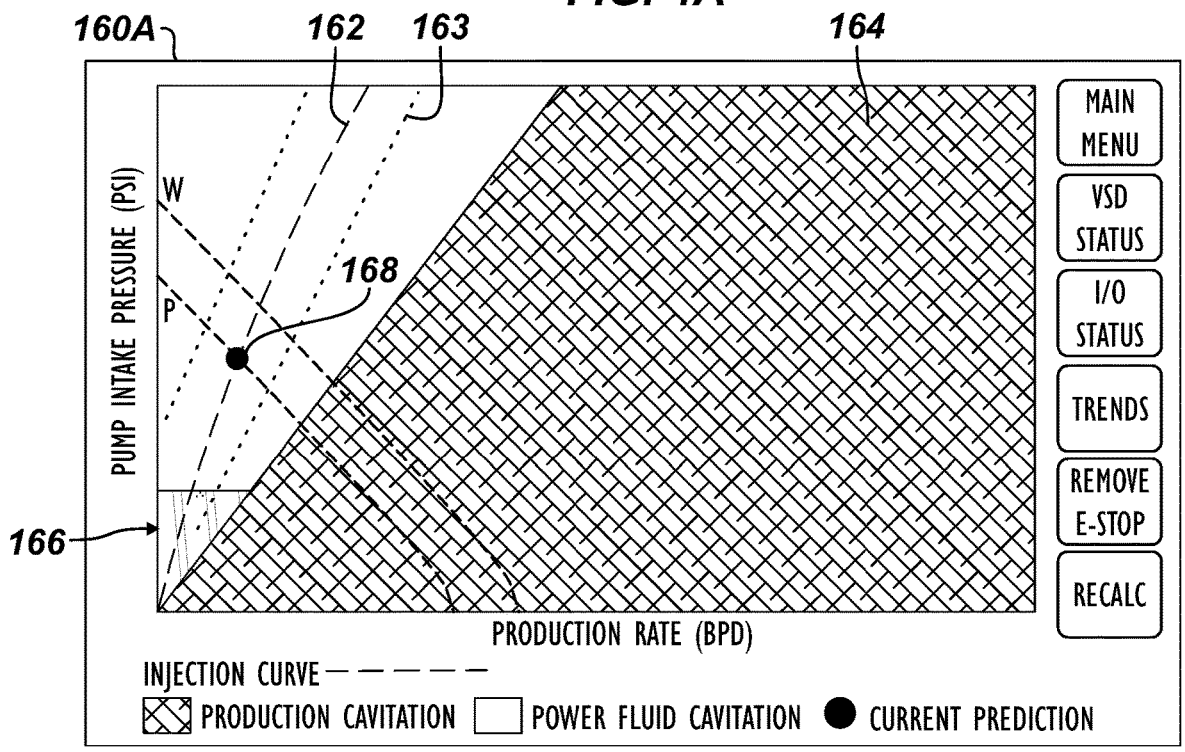

The user interface in FIG. 4A shows an operation screen 150A having current data 152 (i.e., current discharge pressure, suction pressure, flow rate, vibration, etc.) of the system's operation. The status 154 of each of the system's sensing arrangements are indicated as active/inactive. A number of menu controls 156 are provided, such as access to main menu, access to a screen of the variable speed drive, access to input/output configuration, access to trends of sensed information and calculations, an interface to stop the system, an interface to stop the variable speed drive, an interface to start the variable speed drive, and a control to clear an existing alarm. These and other controls 156 are possible.

Finally, a real-time plot 160A is displayed that indicates the current operating condition of the system (40). FIG. 4B shows an independent screen of this real-time plot 160A of the system's current operation. An injection curve 162 and current prediction 168 of the system's operation is calculated by the controller (100) based on current sensing and controls. This current prediction 168 is plotted on the injection curve 162 as a function of production rate (BPD) of the well versus jet pump intake pressure at the downhole jet pump (50). As shown, line P plots the inflow performance relationship (IPR) at the depth of the jet pump (50), whereas W plots the inflow performance relationship (IPR) at the depth of the perforations in the casing or other inflow ports of the completion. The injection curve 162 is a graph of the jet pump's performance curve representing the pump's performance at the current power fluid injection pressure (i.e., the discharge pressure from the surface pump (62)). Thresholds 163 can be graphed relative to the injection curve 162 to define alarm limits or the like for the operating condition 168.

Based on current sensing and controls, the controller (100) also calculates operating parameters predicted to produce cavitation in the downhole jet pump (50). For example, the plot 160A shows an area 164 in which values for the production rate versus the jet pump intake pressure would produce cavitation in the production from the downhole jet pump (50). The plot 160A also shows an area 166 in which values for the production rate versus the jet pump intake pressure would produce cavitation in the power fluid in the downhole jet pump (50).

Operators can assess the system's operation from the plot 160A. Alarms can be automatically generated by the controller (100) when the current prediction 168 of the system's operation falls in (or within a threshold) of these cavitation areas 164, 166. Operators can manually initiate recalculation of the operating parameters, or the controller (100) can automatically recalculate the operating parameters of the jet pump system (40) to move current operation out of these cavitation areas 164, 166. For example, the controller (100) can determine a new flowrate for the power fluid or a new injection pressure fluid, and the controller (100) can adjust the power provided by the variable speed drive (69) to the motor (68) for the positive displacement pump (62) at surface. The controller (100) can also recommend shut down, repair, or the like of the system (40); can recommend resizing of the nozzle, throat, or the like; or can make other recommendations.

Figure 5:
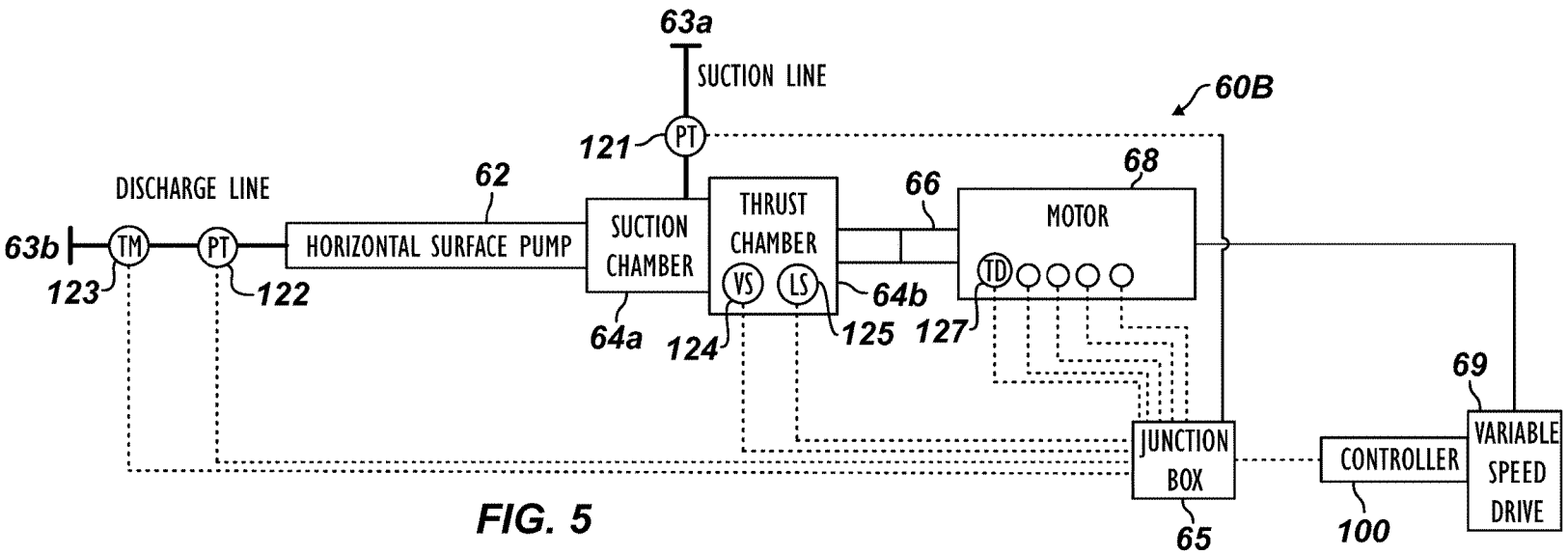
FIG. 5 illustrates the jet pump controller integrated into a horizontal surface pump configuration of a surface power fluid unit.

In another arrangement, FIG. 5 illustrates the jet pump controller 100 integrated into a horizontal pumping system configuration for a power-fluid unit 60B. The horizontal pump 62 can be a centrifugal pump or the like that is actuated by a prime mover (motor) 68 coupled to the surface pump 62 by a transmission 66, a thrust chamber 64*b*, and other necessary components to transfer the rotation of the motor 68 to operate the surface pump 62. The controller 100 provides power to the motor 68 with the variable speed drive 69 to control the drive of the motor 68 to the surface pump 62.

When actuated, the surface pump 62 draws power fluid from a source through a suction line 63*a* into a suction chamber 64*a*. The pump 62 pressurizes the power fluid and discharges the power fluid through a discharge line 63*b* for delivery to the downhole jet pump (50) in the well.

Again, the controller 100 is operatively coupled to the variable speed drive 69 and is operatively coupled to the junction box 65, which connects to the various sensors 120 for monitoring operation of the configuration 60B. The configuration 60B operates in a similar manner to the previous configuration 60A described previously so those previous details are incorporated here. Briefly, the controller 100 exchanges information with the drive 69 to control power to the motor 68. For example, the controller 100 can monitor and control motor parameters, such as Hz, amps, RPM, etc. Using the drive 69, the controller 100 can control of the flow of the power fluid for the system (40) (if needed) by controlling the speed of the motor 68 from the drive 69. If necessary, the controller 100 can also shut down the motor 68 with the drive 69. The centrifugal pump 62 can be sped up or slowed down, and the result can be to change the pressure and the flowrate based on the particular choice of pump stages.

In the control of this configuration of the unit 60B for the jet pump system (40), the software (106) of the controller (100) can provide a number of user interface screens for local display at the controller (100) or for access remotely via satellite, cellular, or other communication. For example, FIGS. 6A-6B illustrate user interface screens 150B, 160B of the jet pump controller (100) of FIG. 5 for monitoring and controlling operation of the configuration 60B in lifting production fluid from the well in conjunction with a downhole jet pump (50).

Figure 6A:
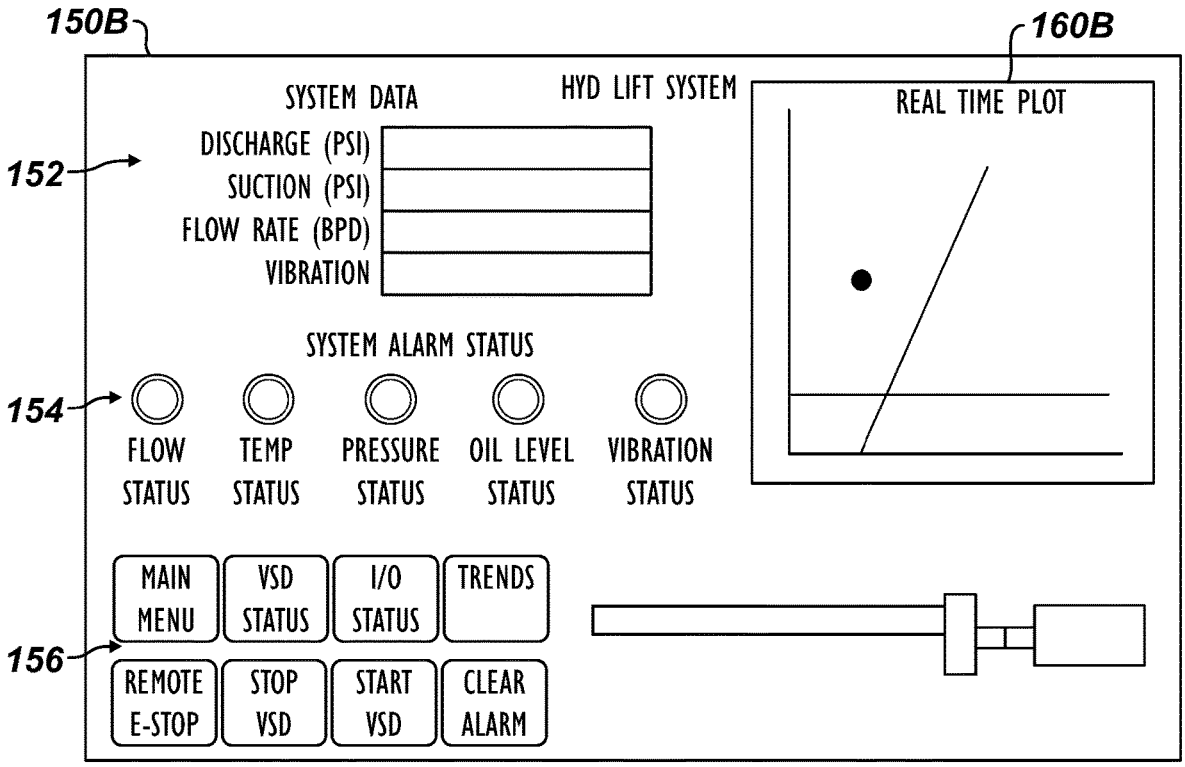
FIGS. 6A-6B illustrate user interface screens of the jet pump controller of FIG. 5.

The user interface in FIG. 6A shows an operation screen 150A having current data 152 (i.e., discharge pressure, suction pressure, flow rate, vibration, etc.) of the system's operation. The status 154 of each of the system's sensing arrangements are indicated as active/inactive. A number of menu controls 156 are provided, such as access to main menu, access to a screen of the variable speed drive, access to input/output configuration, access to trends of sensed information and calculations, an interface to stop the system, an interface to stop the variable speed drive, an interface to start the variable speed drive, and a control to clear an existing alarm. These and other controls 156 are possible.

Finally, a real-time plot 160B is displayed that indicates the current operating condition of the system. This real-time plot 160B can be similar to that discussed previously plotting production rate of the well versus jet pump intake pressure. Based on current sensing and controls, the controller (100) can calculate operating parameters predicted to produce cavitation in the downhole jet pump (50) in a manner similar to that discussed above.

Figure 6B:
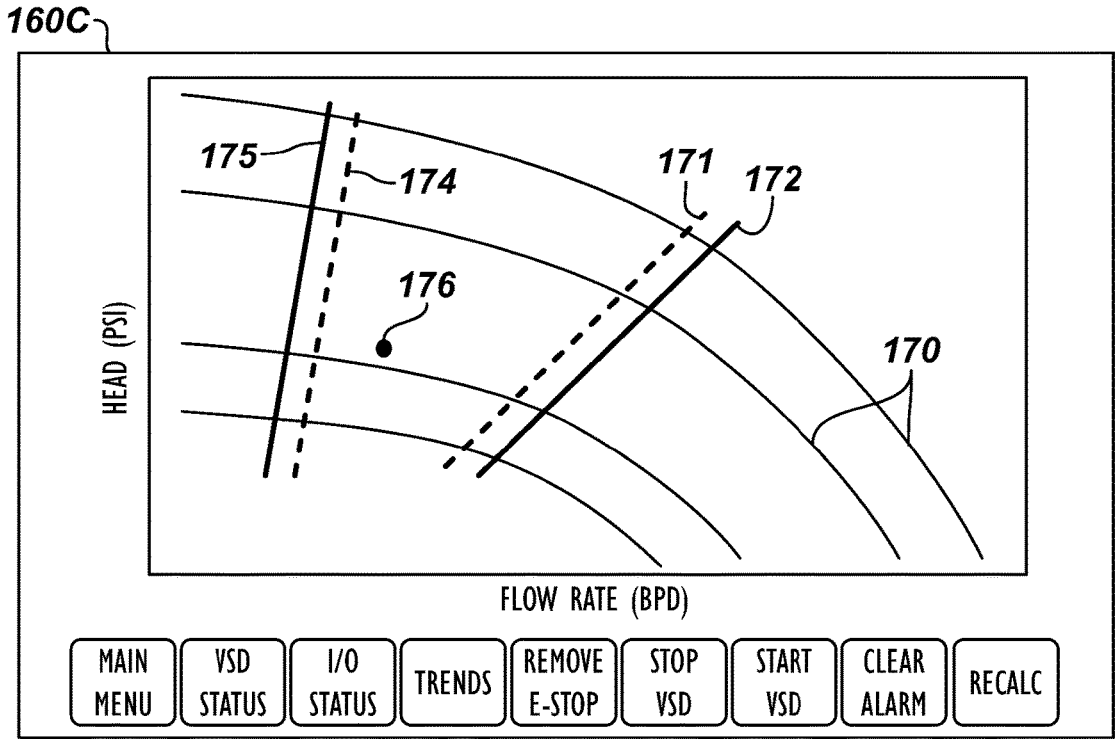

As an alternative, FIG. 6B shows an independent screen of a real-time plot 160C of the system's current operation in which the plot is similar to a Tornado performance chart of an electrical submersible pump. The plot 160C shows performance curves 170 of the centrifugal surface pump (62) at different frequencies. A window having an upper boundary 172 and a lower boundary 175 shows a defined operating range for the surface pump's operation (flow rate, head pressure).

A current prediction 176 of the centrifugal pump's operation (flow rate, current head) is calculated by the controller (100) based on current sensing and controls. This current prediction 176 is plotted as flow rate (barrels-per-day BPD) versus head pressure (PSI) relative to frequency curves 170 having different frequencies for the surface pump (62) increasing outward from the origin.

The plot 160C shows the upper boundary line 172 for values of the pump's operation. This upper boundary 172 can be a limit of the surface pump's window of operation, or may be an operating limit for the surface pump 62 beyond which the system (40) would produce cavitation in the production at the jet pump (50). The plot 160C also shows a lower boundary line 175. This lower boundary can also be a limit of the surface pump's window of operation, or may be an operating limit beyond which the system (40) would produce cavitation in the power fluid at the jet pump (50). Alarm lines 171, 174 may be provided shy of these boundaries 172, 175 representing alarm conditions.

Operators can assess the system's operation from the plot 160C. Alarms can be automatically generated by the controller (100) when the current prediction 176 of the system's operation falls beyond (or within the alarm line's thresholds) of these cavitation boundaries 172, 175. Operators can manually initiate recalculation of the operating parameters, or the controller (100) can automatically recalculate the operating parameters of the jet pump system to move current operation out of these cavitation boundaries 172, 174. For example, the controller (100) can determine a new flowrate for the power fluid, a new injection pressure for the power fluid, or a new operating frequency for the motor (68), and the controller (100) can adjust the power provided by the variable speed drive (69) to the motor (68) for the horizontal pump (62) at surface. The controller (100) can also recommend shut down, repair, or the like of the system; can recommend resizing of the nozzle, throat, or the like; or can make other recommendations.

Figure 7:
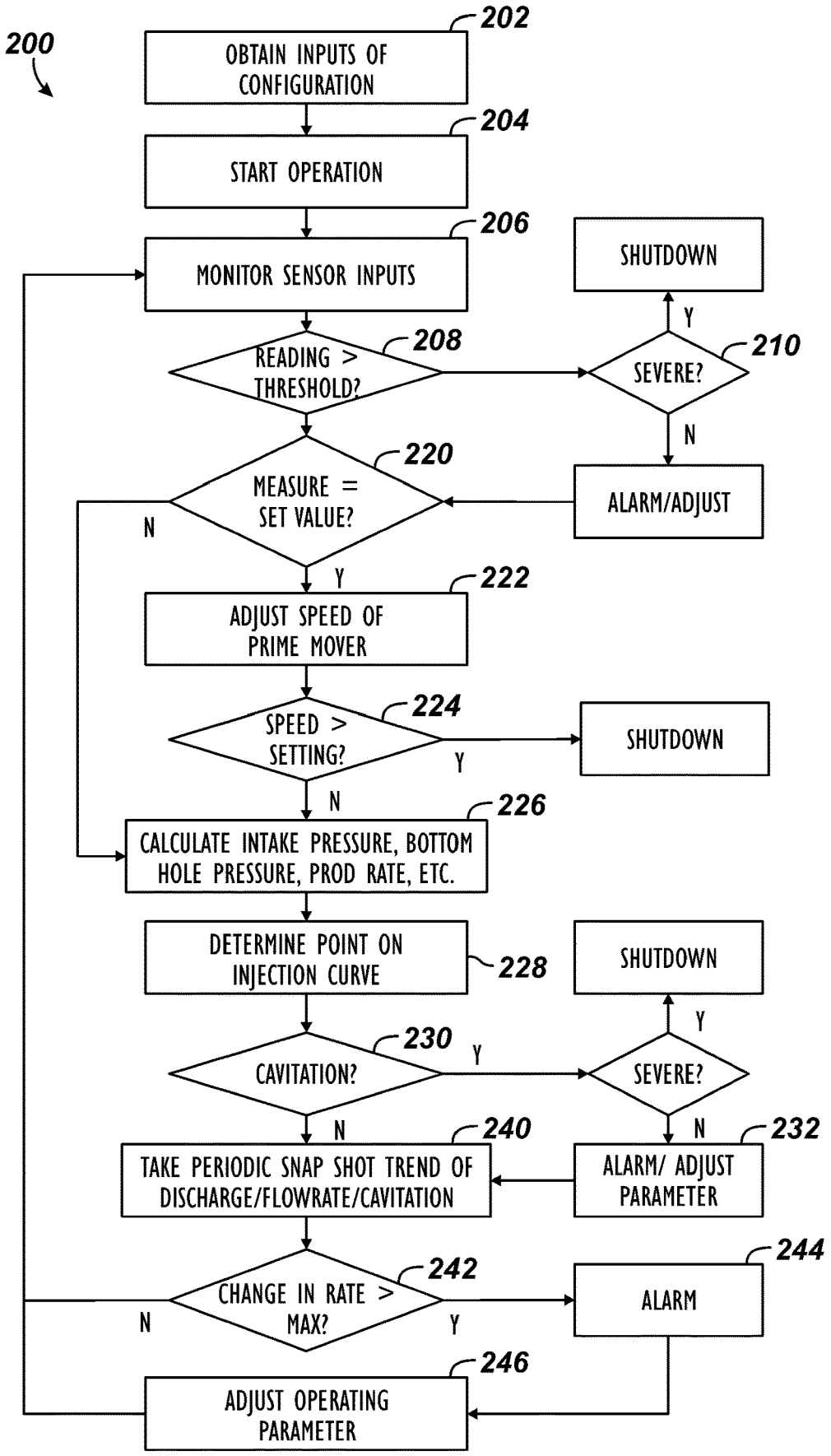
FIG. 7 illustrates a process of operating a hydraulic jet pump system using a jet pump controller of the present disclosure.

FIG. 7 illustrates a process 200 performed by the controller (100) in controlling a hydraulic jet pump system (40) of the present disclosure. For discussion, reference to elements of previous figures will be made.

The controller 100 obtains inputs of the system 40 (Block 202). These inputs include details of the well, bottom hole assembly, downhole jet pump 50, expected production, and the like as noted herein. For example, in the initial configuration of the system 40, the operator inputs or loads equipment details, such as casing size, tubing size, well depth, jet pump depth, etc. The operator also inputs desired well production information and inputs a desired discharge pressure and/or flowrate of the power fluid unit 60.

For the positive displacement configuration of the power-fluid unit 60A, the operator inputs temperature limits, vibration limits, pressure limits, and the like. For the HPS configuration of the power-fluid unit 60B, the operator inputs upper and lower thrust shutdown settings and can enter upper and lower alarm settings if different from the shutdown settings. For both configurations, the operator inputs a Hertz range for the speed control and inputs a desired discharge pressure and/or flowrate for the system 40 to maintain.

These inputs can be entered manually by a field operator using the input/output interface 108*c* of the controller 100 or by loading the inputs through a memory interface. The inputs can also be received from a remote source via the communication interface 114. In the end, the inputs can produce operating parameters for the variable speed drive 69, the flowrate of the power fluid, the injection pressure of the power fluid (i.e., discharge pressure of the pump unit 60), and the like as noted herein.

The controller 100 starts operation of the jet pump system 40 (Block 204), monitors the sensor inputs (Block 206), and determines if the sensor readings are above (or below) set limits or thresholds, as the case may be (Decision 208). This determination can be ongoing throughout the operation of the controller 100. The severity of the reading discrepancy may require shutdown of the system 40 or may just require an alarm.

Once the jet pump system 40 is started, the controller 100 operates the system 40 to maintain the desired discharge pressure and/or flowrate by controlling the speed of the surface pump 62. As the system 40 operates, the discharge flowrate of the unit 60 is going to change to maintain the desired discharge pressure. Alternatively, the discharge pressure of the unit 60 is going to change to maintain a desired flowrate.

Accordingly, the controller 100 monitors whether the discharge pressure or flowrate measured at the discharge 63*b* of the surface pump 62 is at the set desired pressure or flowrate (or at least within a threshold) (Decision 220). If not, the controller 100 determines an appropriate speed for the motor 68 to bring the discharge pressure or flowrate into desired parameters and adjusts the speed of the surface pump 62 with the variable speed drive 69 to maintain the desired discharge pressure or flowrate (Block 212). The desired discharge pressure or flowrate is set to achieve an appropriate bottom hole pressure and efficient production from the well while avoiding cavitation, as noted herein.

The controller 100 can monitor the speed of the motor 68 to determine if it has gone above a protective setting, such as maximum RPM, excessing run time, etc. (Decision 224) in which case the controller 100 may shutdown the motor 68 or perform other actions. For example, if the controller 100 hits a hard limit of a speed range, the controller 100 can open or close a control valve on the discharge line to maintain current pressure. Also, the controller 100 can activate alarms when thrust alarm settings in the HPS configuration of the unit 60B are reached, and the controller 100 can shut down the motor 68 if thrust shutdown settings are exceeded.

As operations continue, the controller 100 can display graphs, can predict the current Bottom Hole Pressure (BHP), can activate an alert of possible cavitation occurring, and can display a point of the current operation on an injection curve. At first, this information will be based on the initial inputs. As operations continue, however, various operating parameters may need adjustment. During operation, for example, the controller 100 calculates predicted bottom hole pressure (Block 226). As noted herein, the predicted bottom hole pressure is calculated based on the discharge pressure of the pump, the production rate from the well, the configuration of the bottom hole assembly, and other characteristics.

Knowledge of the bottom hole pressure allows the controller 100 to determine the current operation point of the downhole jet pump 50 on the injection curve, such as shown in the plot 160A of FIG. 4B (Block 228). Using the determined operation point, the controller 100 can determine whether the point lies in one of the areas of cavitation in the production fluid or the power fluid (Decision 230). If cavitation is estimated, the controller 100 determines the severity to decide whether to shutdown operation, initiate an alarm, or adjust operation.

To determine power fluid cavitation at the jet pump 50 in Decision 230, the controller 100 calculates a predicted operating condition for an intake pressure at the downhole jet pump 50 as a function of a production rate of the product from the well. This calculated operating condition is then compared to a limit, a line, or an area associated with values of intake pressures at the jet pump 50 as a function of the production rates predicted to produce cavitation in the power fluid. In general, the configuration of the system 40, its implementation, and its current operation define how the pump intake pressure and production rate would produce power fluid cavitation in the jet pump 50 that could cause damage. The controller 100 displays real-time data and alarms when the jet pump 50 is predicted to be operating in power fluid cavitation. In response, the controller 100 can shutdown operation, can initiate an alarm, can adjust an operating parameter of the system 40, or can display that the nozzle and throat of the jet pump 50 should be resized.

To determine production fluid cavitation at the jet pump 50 in Decision 230, the controller 100 calculates a predicted operating condition of the jet pump for an intake pressure at the downhole jet pump 50 as a function of a production rate of the product from the well. This calculated operating condition is then compared to a limit, a line, or an area associated with values of intake pressures at the jet pump 50 as a function of the production rates predicted to produce cavitation in the product. In general, the configuration of the system 40, its implementation, and its current operation define how the pump intake pressure and production rate would produce production fluid cavitation in the jet pump 50 that could cause damage. The controller 100 displays real-time data and alarms when the jet pump 50 is predicted to be operating in production fluid cavitation. In response, the controller 100 can shutdown operation, can initiate an alarm, can adjust an operating parameter of the system 40, or can decrease the injection pressure of the power fluid to keep out of the production fluid cavitation area.

On an ongoing basis, the controller 100 takes snap shots for trending, such as at daily intervals. Over time, for example, the discharge flowrate will increase as the bottom hole pressure drops. The controller 100 can then trend the discharge flowrate of the power fluid unit 60 and show the change over time. Using the trend of the discharge flowrate data, the controller 100 can predicts current bottom hole pressures and determine movement of the operation toward cavitation, damage, or the like. The controller 100 can receive updated information of current well production data automatically or manually to improve the prediction.

In particular, the controller 100 takes periodic snap shots of the trends in the system's operation, settings, and readings (Bock 240). As the controller 100 operates to maintain a set discharge pressure by adjusting operation so that the measured discharge pressure remains at the set value, a particular trend of interest is how the discharge flowrate of the power fluid unit 60 changes over time, which can be recorded daily. Over time (e.g., several days), the controller 100 monitors the trend of the discharge flowrate, monitoring how the flowrate changes over time and whether it exceeds a maximum rate of change (Decision 242). An increasing rate of change in the trend of the discharge flowrate will indicate that the jet pump 50 is reaching damage or reaching the limit of its operational capabilities, in which case the controller 100 initiates an alarm condition (Block 244).

For example, the controller 100 periodically (e.g., daily) looks for a change in the discharge flowrate and outputs a percent change from a previous reading. At a certain percentage change, the controller 100 can initiate an alarm indicating that the jet pump 50 needs repair (Block 244). Going beyond an alarm, the controller 100 can also initiate an operation, such as adjusting an operating parameter (Block 246). As discussed below, for example, the controller 100 can shut down the power fluid unit 60 by shutting off the motor, can reduce the set discharge pressure to a new value, can adjust operating of the motor 68 so that the pump unit 60 produces a new flowrate, can recommend resizing of the throat/nozzle of the downhole jet pump, etc.

As the controller 100 operates to maintain a set flowrate by adjusting operation so that the measured flowrate remains at the set value, another particular trend of interest is how the discharge pressure of the power fluid unit 60 changes over time, which can be recorded daily. Over time (e.g., several days), the controller 100 monitors the trend of the discharge pressure, monitoring how the discharge pressure changes over time and whether it exceeds a maximum rate of change (Decision 242). An increasing rate of change in the trend of the discharge pressure will indicate that the jet pump 50 is reaching damage or reaching the limit of its operational capabilities, in which case the controller 100 initiates an alarm condition (Block 244).

For example, the controller 100 periodically (e.g., daily) looks for a change in the discharge pressure and outputs a percent change from a previous reading. At a certain percentage change, the controller 100 can initiate an alarm indicating that the jet pump 50 needs repair (Block 244). Going beyond an alarm, the controller 100 can also initiate an operation, such as adjusting an operating parameter (Block 246). As discussed below, for example, the controller 100 can shut down the power fluid unit 60 by shutting off the motor 68, can reduce the set flowrate of the unit 60 to a new value, can adjust operating of the motor 68 so that the pump unit 60 produces a new discharge pressure, can recommend resizing of the throat/nozzle of the downhole jet pump, etc.

As the controller 100 operates to maintain operation, yet another particular trend of interest is how the operating condition (intake pressure vs. production rate) of the downhole jet pump 50 changes over time, which can be recorded daily. Over time (e.g., several days), the controller 100 monitors the trend of the operating condition, monitoring how the operating condition changes over time and whether the intake pressure vs. production rate is trending toward placing the jet pump into cavitation (Decision 242). An increasing trend of the operating condition toward cavitation will indicate that the jet pump 50 is reaching damage or reaching the limit of its operational capabilities, in which case the controller 100 initiates an alarm condition (Block 244).

For example, the controller 100 periodically (e.g., daily) looks for a change in the operating condition and outputs a percent change from a previous reading. At a certain percentage change, the controller 100 can initiate an alarm indicating that the jet pump 50 needs repair (Block 244). Going beyond an alarm, the controller 100 can also initiate an operation, such as adjusting an operating parameter (Block 246). As discussed below, for example, the controller 100 can shut down the power fluid unit 60 by shutting off the motor, can reduce the set flowrate of the unit 60 to a new value, can adjust operating of the motor so that the pump unit 60 produces a new discharge pressure, can recommend resizing of the throat/nozzle of the downhole jet pump, etc.

In the end when cavitation occurs, when the discharge flowrate has increased in trend over time, and/or when the discharge pressure has increased in trend over time, the controller 100 can adjust an operating parameter of the jet pump system 40 (Block 246). In general, the controller 100 can initiate an operation based on the trending and change over time that involves adjusting the variable speed drive, shutting down the prime mover, adjusting the flowrate, adjusting the discharge pressure, initiating an alarm condition, requesting a repair, and requesting a replacement. Adjusting may include changing any of various suitable parameters of the jet pump system 40, such as replacing or repairing equipment or components; modifying (e.g., increasing/reducing) the speed of the surface motor 68; modifying the discharge flow rate of the power fluid unit 60; modifying the discharge pressure of the unit 60 (which can translate to modifying the injection pressure); storing and/or reporting the indication; setting a flag and/or outputting a signal based on the indication; and the like.

In a particular example, the controller 100 adjusts at least one parameter to avoid cavitation damage. For instance, the controller 100 can decrease the power fluid pressure at the downhole jet pump 50 by decreasing the discharge flowrate or pressure of the power fluid from the surface unit 60 (Block 246). These adjustments can be made before or after cavitation occurs in the jet pump system 40. Overall, a production rate of the jet pump system 40 may be adjusted by increasing production, reducing production, or stopping production. If production is stopped, it may be helpful in certain situations to wait a sufficient time before resuming production for fluid to settle in the wellbore.

In some circumstances, such stop-and-go operation may not be sufficient to resolve the cavitation. For example, the cavitation may be occurring due to improper throat sizing and/or cavitation damage to the downhole jet pump 50. In any case, adjusting the parameter may include removing the downhole jet pump 50 for inspection. If damage from cavitation is present, the jet pump 50 or one or more components thereof can be replaced. Alternatively, at least one component of the jet pump 50 can be replaced with another component to avoid cavitation damage in subsequent wellbore operation. For example, the nozzle 52 and/or throat 55 installed in the jet pump 50 may be replaced with a new nozzle and/or throat that has a different size. The different sized nozzle and/or throat may cause flow of the power fluid and production fluid mixture through the hydraulic jet pump 50 to be altered in such a manner that cavitation does not occur.

Any of the operations described above, such as the operations of the process 200, may be included as instructions in a computer-readable medium for execution by the controller 100. The computer-readable medium may comprise any suitable memory or other storage device for storing instructions, such as read-only memory (ROM), random access memory (RAM), flash memory, an electrically erasable programmable ROM (EEPROM), a compact disc ROM (CD-ROM), or a floppy disk.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An artificial lift system for producing production fluid from a well having tubing disposed therein, the system comprising:

a surface unit disposed at surface, the surface unit having a suction line in communication with a source of power fluid and having a discharge line in communication with the well, the surface unit comprising a variable speed drive operable to pressurize the power fluid from the suction line to the discharge line;

a jet pump disposed downhole in the tubing and receiving the pressurized power fluid, the jet pump mixing the power fluid and the production fluid and outputting a product of the mixed fluid for delivery to the surface;

a first pressure transducer disposed to measure discharge pressure in the discharge line of the surface pump;

a flowmeter disposed to measure discharge flowrate in the discharge line of the surface pump; and a controller disposed in communication with the surface unit, the first pressure transducer, and the flowmeter, the controller being configured to:

calculate a production rate of product from the well, calculate an intake pressure at the downhole jet pump, determine that an operating condition of the jet pump based on the intake pressure at the downhole jet pump as a function of the production rate of the product from the well lies within one of at least two areas predicted to produce cavitation in the product and in the power fluid, adjust the variable speed drive of the surface unit based on the determination.

2. The system of claim 1, wherein the controller is configured to:

adjust the artificial lift system relative to a set value based on a first of the measured discharge pressure or flowrate, trend a change in a second of the measured discharge flowrate or pressure over time, and initiate an operation in the artificial lift system based on the trended change.

3. The system of claim 1, wherein the surface unit comprises:

a prime mover powered by the variable speed drive; and a surface pump connected to the prime mover and operable by the prime mover to pressurize the power fluid from the suction line to the discharge line.

4. The system of claim 3, further comprising at least one of:

a second pressure transducer disposed to measure suction pressure in the suction line of the surface pump;

a vibration sensor disposed at the surface pump, the controller being configured to monitor vibration of the surface pump and compare the monitored vibration to a vibration threshold;

an oil level sensor disposed at the surface pump, the controller being configured to monitor oil level of the surface pump and compare the monitored oil level to an oil level threshold; and a temperature sensor disposed at the prime mover, the controller being configured to monitor temperature of the prime mover and compare the monitored temperature to a temperature threshold.

5. The system of claim 4, wherein the prime mover comprises an electric motor coupled to the variable speed drive.

6. The system of claim 4, wherein the surface pump comprises a positive displacement pump coupled to the prime mover with a gear box.

7. The system of claim 4, wherein the surface pump comprises a centrifugal pump coupled to the prime mover with a thrust chamber.

8. The system of claim 1, wherein the discharge line is disposed in communication with the tubing or an annulus between the tubing and the well; and wherein the jet pump is disposed downhole in the tubing and receives the power fluid from the tubing or the annulus, the jet pump outputting the product of the mixed fluid to the other of the annulus or the tubing for delivery to the surface.

9. The system of claim 8, wherein the jet pump comprises a nozzle, a throat, a diffuser, and an outlet, the nozzle disposed in communication with the power fluid in the tubing, the throat disposed in communication with the production fluid and the nozzle, the diffuser receiving a mix of the power fluid and the production fluid from the throat, the outlet disposed in communication between the diffuser and the annulus.

10. The system of claim 9, wherein to adjust the artificial lift system relative to the set value, the controller is configured to compare the measured discharge pressure to the set value for discharge pressure and adjust the variable speed drive of the surface unit based on the comparison.

11. The system of claim 10, wherein to trend the change, the controller is configured to periodically trend the discharge flowrate over time and compare a rate of change of the trended flowrate relative to a threshold.

12. The system of claim 11, wherein to initiate the operation, the controller is configured, based on the comparison of the rate to the threshold, to at least one of: adjust the variable speed drive, shutdown a prime mover of the surface unit, adjust the discharge flowrate, adjust the discharge pressure, initiate an alarm condition, request a repair, and request a replacement.

13. The system of claim 9, wherein to adjust the artificial lift system relative to the set value, the controller is configured to compare the measured flowrate to the set value for the discharge flowrate and adjust the variable speed drive of the surface unit based on the comparison.

14. The system of claim 13, wherein to trend the change, the controller is configured to periodically trend the discharge pressure over time and compare a rate of change of the trended discharge pressure relative to a threshold.

15. The system of claim 14, wherein to initiate the operation, the controller is configured, based on the comparison of the rate to the threshold, to at least one of: adjust the variable speed drive, shutdown a prime mover of the surface unit, adjust the discharge flowrate, adjust the discharge pressure, initiate an alarm condition, request a repair, and request a replacement.

16. The system of claim 1, wherein to adjust the artificial lift system, the controller is configured to:

calculate a first of the at least two areas of the intake pressure at the jet pump as the function of the production rate predicted to produce the cavitation in the product, determine that the operating condition lies within the first area, and adjust the variable speed drive of the surface unit based on the determination.

17. The system of claim 1, wherein to adjust the artificial lift system, the controller is configured to:

calculate a second of the at least two areas of the intake pressure at the jet pump as the function of the production rate predicted to produce the cavitation in the power fluid, determine that the operating condition lies within the second area, and adjust the variable speed drive of the surface unit based on the determination.

18. An artificial lift method of producing fluid from a well having tubing disposed therein, the method comprising:

pressurizing, with a surface unit of an artificial lift system disposed at surface having a variable speed drive, a power fluid from a suction line to a discharge line;

injecting the pressurized power fluid of the discharge line into the well;

receiving the power fluid at a jet pump of the artificial lift system disposed downhole, mixing the power fluid and the production fluid in the jet pump, and outputting a product of the mixed fluid from the jet pump for delivery to the surface;

monitoring, with a controller disposed at surface and disposed in operable control of the variable speed drive, a discharge pressure of the surface unit with a pressure transducer and a discharge flowrate of the surface unit with a flowmeter;

calculating a production rate of product from the well;

calculating an intake pressure at the downhole jet pump;

determining that an operating condition of the jet pump based on the intake pressure at the downhole jet pump as a function of the production rate of the product from the well lies within one of at least two areas predicted to produce cavitation in the product and in the power fluid;

adjusting the variable speed drive of the surface unit based on the determination.

* * * * *